United States Patent [19]

Arnhold et al.

[11] 4,288,768

[45] Sep. 8, 1981

[54] ELECTRICAL FULL PROTECTION CIRCUIT BREAKER

[75] Inventors: Hans Arnhold, Kälberau; Peter Flohr, Kahl, both of Fed. Rep. of Germany

[73] Assignee: Firma Heinrich Kopp GmbH & Co. KG., Kahl, Fed. Rep. of Germany

[21] Appl. No.: 62,166

[22] Filed: Jul. 30, 1979

[30] Foreign Application Priority Data

Aug. 4, 1978 [DE] Fed. Rep. of Germany ..... 2834327

[51] Int. Cl.[3] ..... H01H 83/02

[52] U.S. Cl. ..... 335/18; 335/9

[58] Field of Search ..... 335/18, 8, 9, 10; 361/45, 44, 356, 357, 358

[56] References Cited

U.S. PATENT DOCUMENTS

| | | | |
|---|---|---|---|
| 3,795,481 | 3/1974 | Klein | 335/18 |
| 3,958,197 | 5/1976 | Gryctko | 335/18 |
| 3,970,975 | 7/1976 | Gryctko | 335/18 |
| 3,999,103 | 12/1976 | Misencik et al. | 335/18 |
| 4,001,652 | 1/1977 | Klein et al. | 361/45 |

*Primary Examiner*—Harold Broome

*Attorney, Agent, or Firm*—W. G. Fasse

[57] ABSTRACT

An electrical full protection circuit breaker for interrupting a current circuit in response to an overload current, or a short circuit current, or in response to an earth leakage or fault current, includes the structural and functional combination of one or several single pole circuit breakers with an earth leakage current circuit breaker. Each circuit breaker has a narrow and compact structure and the same housing contour. The fault current circuit breaker member, which is coupled with one or more single pole circuit breakers, has its own contact interruption elements. Additionally, the fault current circuit breaker is provided in its outwardly located terminal connection zone with a freely accessible summing current transformer which is constructed as a bushing transformer.

10 Claims, 7 Drawing Figures

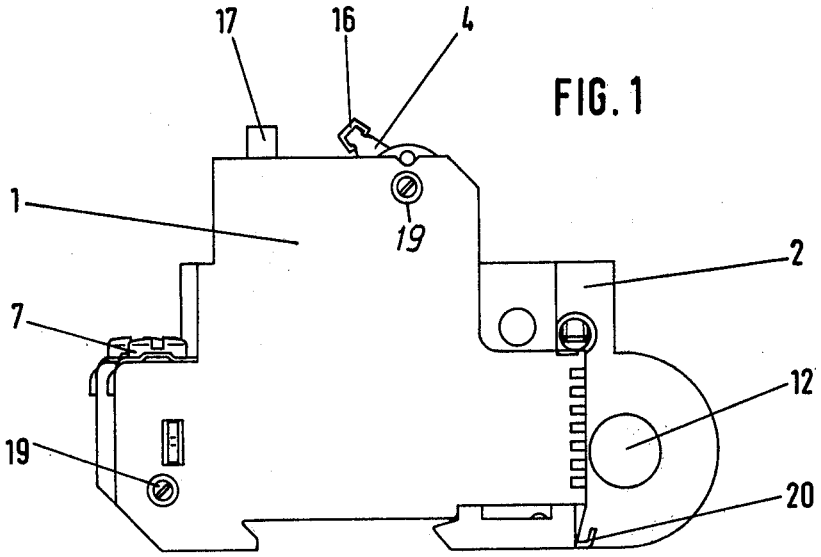
FIG. 1
FIG. 2
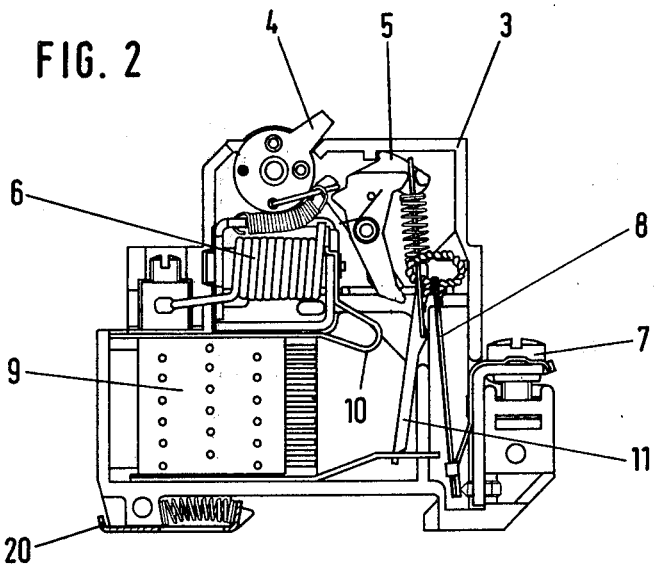

ELECTRICAL FULL PROTECTION CIRCUIT BREAKER

BACKGROUND OF THE INVENTION

The invention relates to an electrical protection circuit breaker which is responsive to overload current, to short circuit current and to earth leakage current. The circuit breaker includes a structural and functional combination of one or several single pole interrupting circuit breakers (LS-circuit breaker) with an earth leakage current circuit breaker (FI-circuit breaker) whereby the circuit breaker elements which are to be combined, are respectively constructed in a compact or narrow manner and with the same housing contour.

Such "full protection circuit breakers" serve simultaneously for the protection of the conductor network to be monitored against short circuiting and against overloading as well as for preventing of electric accidents due to conductor defects and the like. The basic construction of these circuit breakers is known, for example, from German Patent No. 1,169,015. However, the protection circuit breaker described in said German Patent requires an expensive internal wiring which is subject to a high dissipation loss for the LS-circuit breaker member through the summing current transformer of the FI-circuit breaker member and from there back again. Thus, this known circuit cannot be constructed for multi-pole circuit interruption. Further, it is necessary that the contact mechanism of the FI-circuit breaker member must be mechanically actuated by the locking cam of the LS-circuit breaker member. This "feedback" from the FI-circuit breaker magnet through the LS-locking cam back to the FI-contact mechanism is due to the lack of space inside the FI-circuit breaker housing having the same contour and constructed in a compact manner. This is so because already the summing current transformer, the breaker magnet, and the testing device do not leave any space in the housing for the installation of its own circuit interrupting member.

Due to this the practice has turned to constructing the FI-circuit breaker member without its own contact interruption point, said FI-circuit breaker member being coupled in the same housing widths and contour with an LS-circuit breaker member which provides a single pole circuit interruption. In the alternative, where the FI-circuit breaker member is provided with its own breaker and interrupting mechanism and coupled with multi-pole LS-circuit breaker components, the FI-circuit breaker member is wired initially ready for mounting inside and outside of the common housing, (German Patent Publication No. 1,563,827 and German Patent Publication No. 2,756,237). These protective circuit breakers, however, have the disadvantage that the first mentioned type interrupts the load current circuit unpermissibly only in a single pole manner, whereby the apparatus becomes practically ineffective when a mix-up of poles occurs or when the third conductor is hot. The second mentioned structure does not involve this danger. However, instead the FI-circuit breaker member is twice as broad in space as the first mentioned structure. In addition, the dissipation power of the entire circuit breaker is substantially higher due to the involved inner wiring.

OBJECTS OF THE INVENTION

In view of these aggravating disadvantages, it is the objective of the invention to develope an electrical full protection circuit breaker of the type mentioned above, by means of which it is possible to obtain in a simple manner and with a minimum of costs a perfect personnel and material protection against any type of dangers that may occur in case of a fault.

SUMMARY OF THE INVENTION

According to the invention the above objective has been achieved in an electrical full protection circuit breaker according to the introductory portion of patent claim 1 by constructing it in such a manner that the FI-breaker which is coupled with the LS-breaker component or with the LS-breaker components in a circuit mechanical manner, comprises its own contact interruption point and that it is provided in its outer terminal connection zone with a freely accessible summing current transformer constructed as a bushing transformer.

Due to this type of construction one achieves in an art advancing manner that a protective circuit breaker may be produced which interrupts in a double pole manner and which is responsive to excessive current, to short circuit current, and to earth leakage current due to the structural and functional combination of an entirely normal LS-circuit breaker of single pole construction with an FI-circuit breaker member according to the invention.

The circuit breaker requires in a distribution system exactly the same space as an LS-circuit breaker interrupting in a two pole manner while assuring in addition a further protection against the occurrence of an excessive contact voltage. Accordingly, one obtains, when assemblying two or three LS-circuit breaker members with the FI-circuit breaker member according to the invention a full protection circuit breaker of the three or four pole type with respective assembly modular units. Further, the same combination achieves a "true" fault or earth leakage protection circuit breaker due to the assembly of an LS-circuit breaker member without thermal and electro-magnetic overload protection. Additionally, the full protection circuit breaker according to the invention may be equipped with a time delay responsive to a voltage less than the rated voltage, whereby one and the same device performs a total of four different protection functions.

A further advantage of the full protection circuit breaker according to the invention, as compared to the above mentioned devices, resides in that the summing transformer required for the earth leakage current sensing, is constructed as a bushing transformer within the FI-circuit breaker member, which may be wired from the outside during normal installation. Thus, not only has the prior inner wiring of the protection circuit breaker been obviated and with it the heating of the apparatus resulting from the substantial dissipation loss, rather it is also possible to double or multiply in a normal installation the response sensitivity of the earth leakage current interrupter depending on the respective circumstances by looping-in the connecting conductors twice or several times. In the same way it is possible to operate the full protection circuit breaker without any leakage current monitoring. This simple adaptation capability not only increases the safety level of the normal protection circuit breaker, it also reduces in the same manner and basically the many prior types of earth leakage current circuit breakers having rated leakage currents of 15, 30, 100 mA and so forth.

The structural size of the full protection circuit breaker according to the invention corresponds to the width of a two or multiple-pole LS-circuit breaker. Thus, the advantageous possibility is provided to secure the current circuit monitored in a given distribution system against fault occurrence without any additional space requirement. Simultaneously it is possible to monitor the given and/or further current circuits independently of each other, that is, in a more differentiated manner since the prior fault current protection circuit breakers are no longer necessary. Additionally, the sum of the leakage currents to be monitored and of the earth loss currents at the operating means is smaller in the full protection circuit breaker according to the invention than in conventional installations where several current circuits are run through a common fault current circuit breaker which necessarily leads to faulty circuit breaking. Thus, the full protection circuit breaker according to the invention provides in addition to its large protection range in the same manner a high operational safety.

In an advantageous embodiment of the full protection circuit breaker according to the invention the breaker and release means and the electro-magnetic release member as well as the breaker contact device coupled herewith are constructed and arranged to be substantially identical or are equal with regard to their mounting for the LS-breaker member and for the FI-breaker, whereby the production of the two breaker members is very much simplified. In this connection, the magnetic holding relay or the amplifier electronic means for the earth leakage current breaking is arranged inside the FI-circuit breaker housing instead of the arc chamber and the light quenching stack on the side of the LS-breaker member, whereby the amplifier electronic means are supplied from the alternating current mains. In connection with multi-pole devices the mains supply of the amplifier electronic means takes place in a manner known as such by the formation of a three-phase Y-circuit and through series connected rectifier circuits. In addition, it is possible to install in this zone, if necessary, also an arrangement for the time delayed response to a voltage less than the rated voltage.

According to a further embodiment of the invention the mechanical coupling of the LS-circuit breaker members relative to each other and relative to the FI-circuit breaker is accomplished by means of a T-shaped tilting lever which is respectively, movably supported in the area of the housing wall of one circuit breaker member on the rigid axis of the circuit breaker mechanism and which extends with its cross bar to both sides through the walls of the adjacent circuit breaker members. The cross bar is actuable for the purpose of the release by each circuit breaker member, and in its effect on the adjacent, by a stud of the cocking and uncocking levers. In addition, all operating means of the thus intercoupled LS- and FI-circuit breaker members are rigidly connected with each other for the purpose of a simultaneously switching on. For this purpose the outer ends are rigidly connected with each other by means of a U-shaped metal coupling bar which overlaps said outer ends of the operating means in a self-holding manner. In this way it is possible to couple the respectively finish mounted and closed LS-circuit breaker members and the FI-circuit breaker without any intervention in their switching and release mechanism. There is also no need for any internal intermediate wiring and the coupling may be accomplished by merely inserting or slipping over of the connecting members which as such are loose, when the breaker members are assembled while simultaneously maintaining the modular structure when the breaker members are coupled in a manner proper with regard to their function and assembly.

With regard to the required testing device of the FI-circuit breaker member, the operating key is displaceably guided within a housing recess and held in the rest position by means of a return spring. The return spring is wound about a stud in the form of a leg spring which holds with its longer leg the actuating key through which the spring reaches within an X-shaped notching. The spring holds the actuating key in an adjustable manner while simultaneously reaching behind a lateral housing shoulder. As compared to the longer leg, the shorter leg of the return spring functions as the current supply to the testing resistor from the hot magnet yoke of the electro-magnetic release member through the auxiliary winding of the bushing transformer, whereby the longer leg of the return spring simultaneously forms the movable auxiliary contact within the testing current circuit. In this shape the testing device merges organically and without any special effort into the present structure of the FI-circuit breaker member without overloading the same in any way whatsoever by additional wiring features and structural details.

The housings of the LS-circuit breaker members and of the FI-circuit breaker have substantially the same contour for the final assembly of the different modular units to form a finished apparatus. For the same purpose, the housings comprise projections or recesses reaching one into the other in a form-locking manner. These projections or recesses are located at connecting positions on the side of the housings facing each other. The connecting positions are located diagonally opposite each other and also extend crosswise through the support pin for the actuating means as well as in the zone of the lateral connecting terminals. These connecting positions correspond to one another. The outer wall of the LS-circuit breaker member forms simultaneously the covering of the FI-circuit breaker which is partially open on the one side. Accordingly, it is possible to assemble the respectively required number of circuit breaker parts with an exact alignment relative to each other with the aid of two screw sleeves, thereby forming a full protection circuit breaker ready for installation.

BRIEF FIGURE DESCRIPTION

The above described structural and functional features of a full protection circuit breaker according to the invention are illustrated in the accompanying drawings with reference to an example embodiment.

FIG. 1 shows a side view of the apparatus which is assembled to comprise the LS-circuit breaker member interrupting in single pole fashion, and the FI-circuit breaker;

FIG. 2 shows the construction of the LS-circuit breaker member in an opened condition;

DETAILED DESCRIPTION OF PREFERRED EXAMPLE EMBODIMENTS AND OF THE BEST MODE OF THE INVENTION

Figure 3:
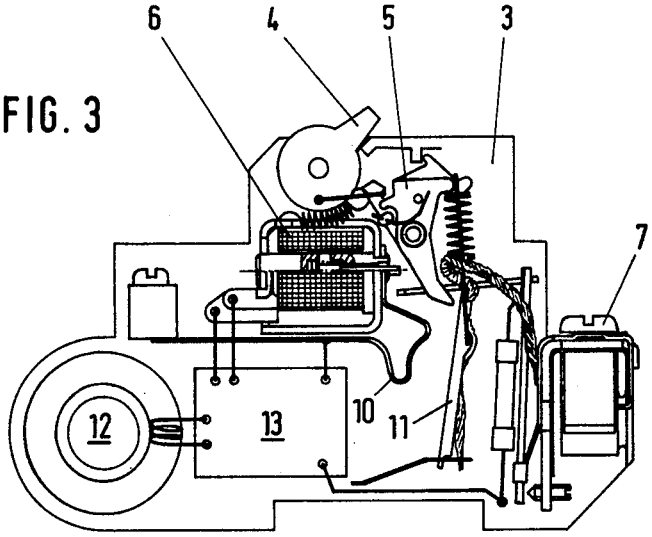
FIG. 3 shows a corresponding illustration of the construction of the FI-circuit breaker member.

As is evident from the illustration in FIGS. 1 to 3 of the drawings, the two pole full protection circuit breaker comprises a single pole interrupting LS-circuit breaker member 1 and an FI-circuit breaker member 2 having its own contact interruption point. FIG. 2 shows a longitudinal section of the LS-circuit breaker member 1 which is constructed in accordance with the detailed description set forth in German Utility Model No. 7,508,649 according to which the member 1 comprises a mechanical cocking device 5 for manually switching on a circuit breaker mechanism which may be switched off respectively either manually, electromagnetically, or electro-thermally. The circuit breaker mechanism comprises a contact device 10/11 and is arranged in the facing side in front of the quenching stack 9 in the arc chamber.

On the other hand, the FI-circuit breaker member 2 shown in FIG. 3 comprises primarily the same functional elements in the same arrangement. In this instance the cocking mechanism 5 is also located in the upper portion of the flat housing 3 made of insulating material. The cocking mechanism 5 may be switched on by the actuating handle 4. The electro-magnetic release member 6 which cooperates with the cocking mechanism 5 is also located in the upper portion of the housing. The lower portion of the housing 3 is occupied, in connection with the LS-circuit breaker member 1, by the bimetal strip 8 connected with a terminal 7 of the electro-thermal release member and substantially by the arc quenching device 9. The circuit breaker section comprising the fixed contact piece 10 protruding like a horn and the movable tilting contact piece 11 is arranged between the terminal 7 and the arc quenching device 9. In distinction thereto, in this zone of the FI-circuit breaker member 2 there is arranged the transformer 12 constructed as a bushing transformer inserted in a laterally protruding housing vault. Further, instead of the LS-quenching stack 9, the holding magnet relay 13 is arranged here between this element and the contact mechanism 10/11 (as well as the terminal 7). This element may be freely wired from the outside. In the alternative, instead of the LS-quenching stack 9 there may be arranged the amplifier electronic means which are supplied from the a.c. mains and which are provided for the fault current release.

Figure 4:
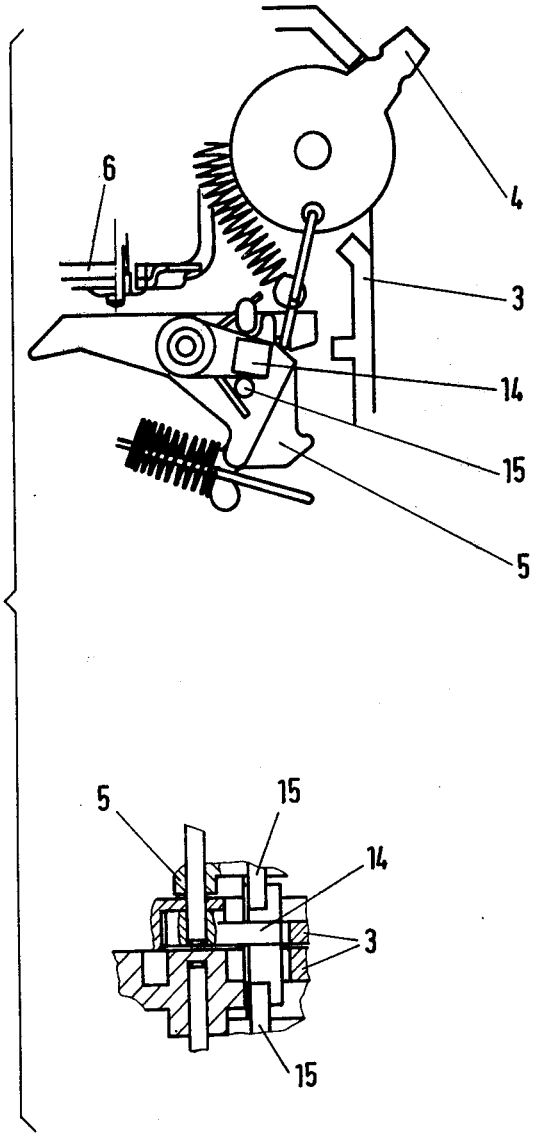
FIG. 4 shows on an enlarged scale the detail of the arrangement of the tilting lever for the coupling of the two circuit breaker members relative to the corresponding elements of the circuit breaker and release mechanism.

Regarding the functional coupling of the two circuit breaker members 1 and 2 for the purpose of switching on and for the circuit breaking, there is provided according to the partial view in FIG. 4, a T-shaped tilting lever 14. This coupling member is supported in the area of the housing cover 3 in a tiltable manner on the axis of the cocking mechanism 5 of the one circuit breaker member 1. The coupling member is actuated on its cross bar extending through the covering 3, by means of a stud 15 of the respective cocking mechanism 5. Thus, the release moment is transmitted through a wall opening to the respectively constructed cocking mechanism 5 of the other circuit breaker member 2. Further, the actuating means 4 of the two circuit breaker members 1 and 2 are rigidly coupled with each other for the manual switching-on. The rail member 16 overlaps and clamps the outer ends of the actuating means 4 in the manner of a U-shape as may be seen from FIGS. 1, 6, and 7.

Figure 5:
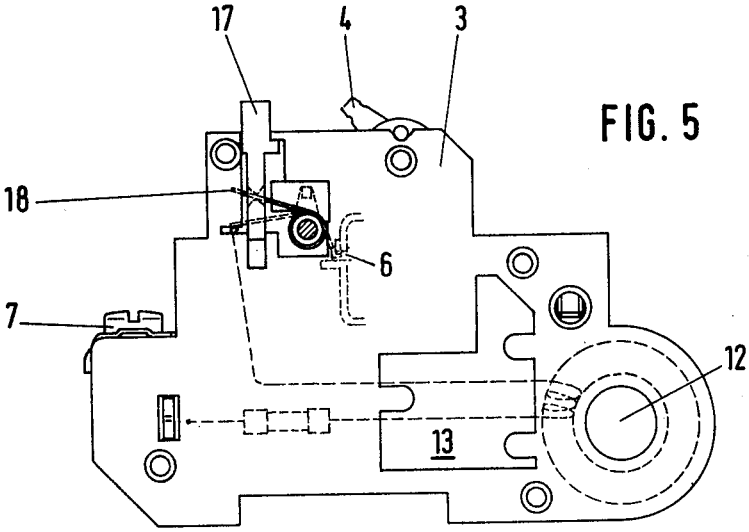
FIG. 5 shows the arrangement of the testing key and its return spring in the testing current circuit of the FI-circuit breaker member.

The construction of the testing device for checking the effectiveness of the FI-circuit breaker member may be seen from FIGS. 3 and 5 of the drawing. The latter shows that the testing key 17, which is guided for vertical displacement in a lateral recess of the insulating material housing 3, is held by a leg spring 18 wound around a stud, thereby holding the key 17 in the rest position. For this purpose the longer leg of the spring reaches through the stem of the testing key 17 in an X-shaped notching and supports itself with its free end behind a wall shoulder of the housing 3. At the same time, the return spring 18 serves as a movable auxiliary contact within the testing current circuit in that its shorter leg bears, in a contact forming manner, against the hot magnet yoke of the electro-magnetic release member 6. Its longer leg performs the contact making upon actuation of the testing key 17 in the direction of the auxiliary winding of the summing current transformer 12. The auxiliary winding is connected through the testing resistor to an opposite potential.

Figure 6:
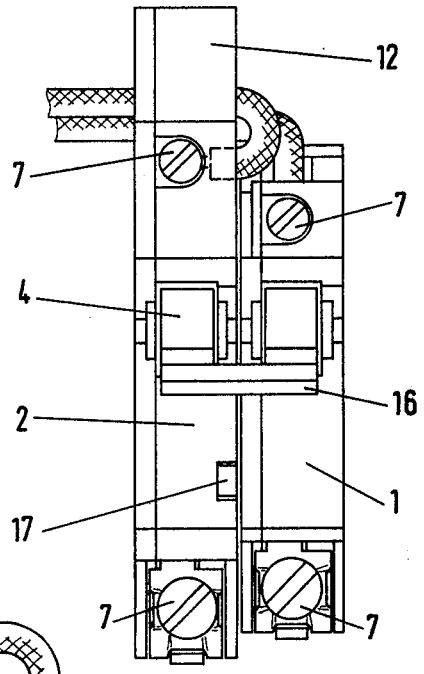
FIG. 6 shows the front view of the two pole full protection circuit breaker in its wired condition and as viewed toward the operating side.
Figure 7:
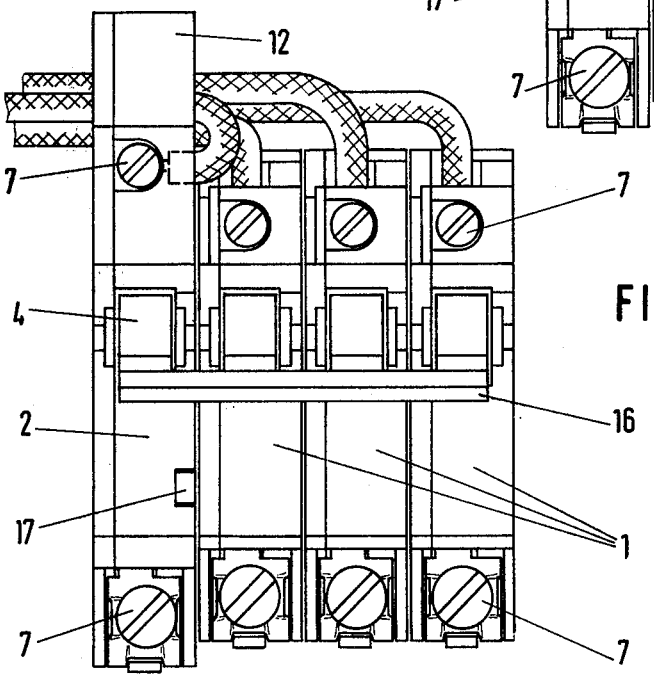
FIG. 7 is a respective view of a four pole full protection circuit breaker.

For the assembly, the two circuit breaker housings 3 comprise two bores 19. One bore is located below the terminal 7. The other bore is located diagonally opposite so as to extend through the journal pin of the actuating means 4. The bores continue on the side of the covering 3 of the LS-circuit breaker member 1 in the form of short lugs extending outwardly. The two lugs reach, upon assembly, in a form locking manner into the correspondingly widened bores 19 of the FI-circuit breaker housing 2 whereby it becomes possible to solidly connect the two circuit breaker members 1 and 2 with each other by using two threaded sleeves thereby providing in proper form a two pole full protection circuit breaker. The completed full protection circuit breaker may then be secured to the mounting rail of a power distribution system by means of the snap-in members 20 on the underside of the LS-circuit breaker member 1. The wiring may be done as shown in FIG. 6. The conductor wires extending toward the load current circuit are looped, prior to their connection to the terminals 7, one or several times through the ring opening of the bushing transformer 12 in accordance with the desired response sensitivity of the apparatus. FIG. 7 of the drawing shows in this respect for completeness sake how a full protection circuit breaker according to the invention may be assembled and wired to form a four pole embodiment comprising three LS-circuit breaker members 1 and one FI-circuit breaker 2.

Although the invention has been described with reference to specific example embodiments, it will be appreciated, that it is intended to cover all modifications and equivalents within the scope of the appended claims.

What is claimed is:

1. An electrical full protection circuit breaker for interrupting the current circuit in response to an overload current, a short circuit current, or an earth leakage or fault current, comprising the structural and functional combination of single pole circuit breaker means with an earth leakage current circuit breaker means, each having a narrow structure and the same housing contour, said leakage current circuit breaker means comprising its own contact interruption means (10, 11) and its own outwardly located terminal connection zone including a summing current transformer means accessible from outside the circuit breaker and constructed as a bushing transformer located in said terminal connection zone for operatively electrically coupling with the single pole circuit breaker means through connecting conductors leading to the circuit breaker means for detecting current, and means operatively mechanically coupling said single pole circuit breaker means and said leakage current circuit breaker means in switching engagement to form an effective double pole circuit breaker combination.

2. The full protection circuit breaker according to claim 1, wherein said bushing transformer has a ring opening and wherein the current detecting response sensitivity of said leakage current circuit breaker means is selectively variable during the installation by means of a single or a repeated looping-in of the connecting conductors through said ring opening of said bushing transformer (12).

3. The full protection circuit breaker according to claim 1, further comprising breaker and release means (5), and an electro-magnetic release member (6), which together with said contact interruption means (10, 11) of the leakage current circuit breaker means and of said single pole circuit breaker means are constructed and arranged to be substantially identical to one another and are equal with regard to their mounting.

4. The full protection circuit breaker according to claim 1 or 3, further comprising holding relay means (13) or electronic amplifier means operatively arranged inside the leakage current circuit breaker means (2, 3), said amplifier electronic means being supplied from an alternating current mains.

5. The full protection circuit breaker according to claim 4, further comprising three phase Y-circuit means and series connected rectifier means for supplying the electronic amplifier means (13) in a multi-pole circuit breaker.

6. The full protection circuit breaker according to claim 3, further comprising T-shaped tilting lever means (14) for the mechanical coupling of the single pole circuit breaker means to each other and to the leakage current circuit breaker means, said breaker and release means (5) comprising a rigid axis, said T-shaped tilting lever means (14) being supported on said rigid axis in the area of the housing wall (3) of one of the circuit breaker means, said tilting lever means (14) having a cross bar extending on both sides through the walls (3) of the adjacent circuit breaker means, said breaker and release means (5) further comprising a stud (15) for actuating said tilting lever (14), whereby said tilting lever (14) is operated alternatingly.

7. The full protection circuit breaker according to claim 6, further comprising actuating means (4) for the single pole circuit breaker means and for the leakage current circuit breaker means which are coupled with each other in a circuit breaker mechanical manner, and common coupling rail means (16) for rigidly connecting said actuating means to each other at their outer ends thereof, said rail means overlapping said outer ends of said actuating means.

8. The full protection circuit breaker according to claim 1, further comprising testing means including actuating testing key means (17) guided in a displaceable manner within a housing recess and held in the rest position by means of a return spring which is wound about a stud in the form of a leg spring (18) which holds with its longer leg the actuating testing key means (17), whereby the longer spring leg extends through a notching of the actuating testing key means while simultaneously reaching behind a lateral housing shoulder for holding the actuating testing key means displaceable in the housing.

9. The full protection circuit breaker according to claim 8, wherein the shorter leg of the leg spring (18) functions as the current supply to a test resistor from the hot magnet yoke of the electro-magnetic release member (6) through the auxiliary winding of the bushing transformer (12), whereby the longer leg of the leg spring (18) simultaneously forms the movable auxiliary contact within the testing current circuit.

10. The full protection circuit breaker according to claim 1, further comprising housing means (3) which have substantially the same contour, for the single pole circuit breaker means (1) and for the leakage current circuit breaker means (2), are provided on the sides facing each other with projections or recesses reaching one into the other in a form locking manner, said projections or recesses being located at connecting positions (19) situated diagonally relative to each other, whereby the outer housing wall of the single pole circuit breaker means (1) forms a covering for the leakage current circuit breaker means (2) which is partially open on one side, said projections or recesses corresponding to one another.

* * * * *